United States Patent [19]

Kawai et al.

[11] Patent Number: 4,685,272

[45] Date of Patent: Aug. 11, 1987

[54] SHEET SEPARATING DEVICE IN A PACKAGING MACHINE

[75] Inventors: Koji Kawai; Hisashi Murata; Koichi Okamoto, all of Hiroshima, Japan

[73] Assignee: Mitsubishi Jukogyo Kabushiki Kaisha, Tokyo, Japan

[21] Appl. No.: 900,627

[22] Filed: Aug. 26, 1986

[30] Foreign Application Priority Data

Sep. 27, 1985 [JP] Japan ..... 60-147909[U]

[51] Int. Cl.[4] ..... B65H 5/08

[52] U.S. Cl. ..... 53/389; 271/101; 414/128; 493/123; 493/317

[58] Field of Search ..... 414/128; 271/101, 100, 271/99; 53/389, 571, 573, 228; 493/317, 316, 123, 124, 125

[56] References Cited

U.S. PATENT DOCUMENTS 2,914,323 11/1959 Sramek ..... 271/101 X
3,069,158 12/1962 Engleson et al. ..... 271/101 X
3,156,167 11/1964 Galloway ..... 493/317
3,618,482 11/1971 Bowman ..... 53/389 X
4,066,009 1/1978 Calvert et al. ..... 493/316
4,116,428 9/1978 Schubert ..... 271/101 X

FOREIGN PATENT DOCUMENTS 53-19276 6/1978 Japan .

*Primary Examiner*—James F. Coan
*Attorney, Agent, or Firm*—Wenderoth, Lind & Ponack

[57] ABSTRACT

In order to constitute means for reliably separating sheets positioned at the lowermost level in a magazine one by one, there are provided two stages of main and auxiliary side hooks which can be rocked in the direction for supporting the sheets and in the direction for releasing the same as operated inversely to the seam hooks, on the both left and right sides of the magazine so that the side hooks can be rocked in correlation with suction arms, each of the respective side hooks has its supporting position for the sheets made variable, and the side hooks are adjustably disposed so that the interval between the side hooks on the left and right sides of the magazine can be varied with the main and auxiliary side hooks on each side held integrally.

1 Claim, 8 Drawing Figures

SHEET SEPARATING DEVICE IN A PACKAGING MACHINE

BACKGROUND OF THE INVENTION

1. Field of the Invention

The present invention relates to a sheet separating device in a packing machine that can be applied to a wraparound caser in which flat sheets positioned at the lowermost level in a magazine disposed in an inclined attitude for accommodating the flat sheets are taken out one by one as separated from each other, then the sheet is folded into a U-shape, and it is delivered to article packing and shaping devices in the subsequent step of a process.

2. Description of the Prior Art

At first, one example of a wraparound caser in the prior art will be explained with reference to FIGS. 7 and 8. The illustrated wraparound caser is composed of a magazine 02 disposed in an inclined attitude for accommodating flat sheets 01 such as corrugated cardboard paper sheets, carton paper sheets or the like; a device for separating only one sheet positioned at the lowermost level in the magazine from the other sheets, that includes seam hooks 03 which are rockable in the direction for supporting the sheets and in the direction for releasing the same, side hooks 04 operated inversely to the seam hooks for supporting the sheets, the seam and side hooks being operated in a correlated manner with each other by a cam mechanism, and a suction arm 013 having vacuum cups 014 and adapted to be rocked while sucking the sheet 01 at the lowermost level; a vacuum cup arm 06 provided with vacuum adhesion means having vacuum cups 05 and driven by a crank mechanism so as to pull down the only one sheet separated by the sheet separating device and thereafter to be held still for a predetermined period of time; fixed guides 07 and 08 adapted to be engaged with the sheet that is being pulled down for folding the sheet into a U-shape; a case pusher 09 driven by a link mechanism so as to push out the U-shaped sheet 01' nearly in the horizontal direction during the temporary stop of the vacuum arm 06; and bucket conveyor chains 010*a* stretched in an endless manner in association with bucket conveyor guides 011 and 012 for transporting the U-shaped sheet 011' that has been pushed out by the case pusher. In this bucket conveyor 010, during transportation of the U-shaped sheets 01', articles are fed to the U-shaped sheets 01' in the direction at right angles to the direction of traveling while constraining the flaps of the U-shaped sheets 01' with the bucket conveyor guides 011 and 012, and in the next step of the process the case is shaped by a shaping device and then delivered.

Now, description will be made on a separating device for the sheets in the packaging machine having the above-mentioned construction. A sheet 01 positioned at the lowermost level in the magazine 02 has its one end supported by seam hooks 03*a* and 03*b*, and the other end by a fixed guide 07, and further on the both left and right side surfaces, nearly at its central portion it is supported by side hooks 04*a* and 04*b*. A vacuum cup arm 06 is fixedly secured to a link 015 via a pin 016, so that they can be rocked integrally about a fulcrum at the pin 016. Reference numeral 017 designates a drive link, to this link 017 are successively articulated a link 018 and a link 019, and a four-articulation linkage is formed by these links. If a link 021 pivotably mounted at an appropriate one point 020 to the link 018 is pivotably connected to the above-mentioned link 015, then in response to rotation of the drive link 017, the vacuum cup arm 06 achieves an intermittent motion in which the arm 06 rocks between the positions 06*a* and 06*b* and temporarily stops at the position 06*b*.

It is to be noted that the drive link 017, the suction arm 013, the seam hooks 03*a* and 03*b*, the side hooks 04*a* and 04*b*, another drive link 09*a* for driving the case pusher 09 in the next stage, respective cams for driving bottom flap tackers not shown, and the chains 010*a* of the bucket conveyor 010 are regulated in their relative timing, and they are driven synchronously.

In the above-described construction, means for separating the sheets one by one is constructed of the suction arm 013, the seam hooks 03*a* and 03*b* and the side hooks 04*a* and 04*b* which are rocked by cam mechanisms. More particularly, at the timing when the vacuum cups 014*a* and 014*b* on the suction arm 013 suck the sheet 01 appearing at the bottom surface of the magazine, the seam hooks 03*a* and 03*b* release the sheet 01, while the side hooks 04*a* and 04*b* support the sheet 01, as shown in FIG. 7.

Subsequently, when the suction arm 013 has rocked up to a predetermined position and has separated one sheet 01, the seam hooks 03*a* and 03*b* rock to the direction for supporting the sheets and support the remaining sheets, thereafter the side hooks 04*a* and 04*b* release the lowermost sheet 01, and thereby the lowermost sheet 01 is separated from the other sheets in the magazine 02. Furthermore, the sheet separating means is constructed such that at this timing, suction of the separated sheet 01 by the vacuum cups 05 on the vacuum cup arm 06 is effected, then in coincidence with the timing for separating the one sheet 01 by downward rocking of the vacuum cup arm 06 the side hooks 04*a* and 04*b* rock in the direction for supporting the sheets and support the remaining sheets, and further, by rocking the vacuum cup arm 06 up to a predetermined position 06*b*, delivery of only one sheet 01 can be effected.

According to the above-described construction for separating one sheet in the prior art, at the timing when the vacuum cups 014*a* and 014*b* on the suction arm 013 suck the sheet 01 appearing at the bottom surface of the magazine, the seam hooks 03*a* and 03*b* release the sheets 01, and when the one sheet is separated by rocking the suction arm 013 downwards by a predetermined angle, the seam hooks 03*a* and 03*b* would rock to support the remaining sheets, thereafter the side hooks 04*a* and 04*b* release the sheets 01, and at that moment when pull down of a single sheet is effected by suction effects of the vacuum cups 05 on the vacuum cup arm 06, since the remaining sheets are held supported by the seam hooks 03*a* and 03*b* and the fixed guide 07 on the opposite side, when the lowermost sheet is singly sucked and pulled down by the vacuum cups 05 on the vacuum cup arm 06, there may occur the phenomenon that the lowermost sheet 01 and the sheet just above the lowermost sheet that is overlapped with the sheet 01 cannot be separated perfectly from each other due to a vacuum force generated by the fact that overlapped sheets are abruptly peeled off and hence a plurality of sheets are separated as adhering to each other. Therefore, the prior art construction involved the problem that not only the separating device can be hardly adapted to different kinds and sizes of sheets, but also reliable separation of sheets one by one cannot be achieved.

SUMMARY OF THE INVENTION

It is therefore one object of the present invention to provide a novel sheet separating device in a packaging machine, in which device flat sheets stacked in a magazine can be reliably separated one by one without being accompanied by the phenomenon that a plurality of sheets are jointly separated from the remaining sheets as adhering to one another.

Another object of the present invention is to provide an improved sheet separating device in a packaging machine, which device can be easily adapted to different kinds and sizes of sheets by appropriately varying adjustably variable portions of the sheet separating device.

According to one feature of the present invention, in a sheet separating device in a packing machine which machine includes a magazine disposed in an inclined attitude for accommodating flat sheets, a sheet separating device for separating only one sheet positioned at the lowermost level in the magazine from the other sheets, which device consists of seam hooks that can be rocked in the direction for supporting the sheets and in the direction for releasing the same, side hooks that can be operated inversely to the seam hooks for supporting the sheets, and suction arms each having vacuum cups and sucking and rocking the sheet at the lowermost level, a vacuum cup arm provided with vacuum adhesion means and driven by a crank mechanism so as to pull down the only one sheet separated by the sheet separating device and thereafter to be held still for a predetermined period of time, and fixed guides adapted to be engaged with the sheet that is being pulled down for folding the sheet into a U-shape; in order to constitute means for reliably separating sheets positioned at the lowermost level in the magazine one by one, there are provided two stages of main and auxiliary side hooks which can be rocked in the direction for supporting the sheets and in the direction for releasing the same as operated inversely to the seam hooks, on the both left and right sides of the magazine so that the side hooks can be rocked in correlation with the suction arm, each of the respective side hooks has its supporting position for the sheets made variable, and the side hooks are adjustably disposed so that the interval between the side hooks on the left and right sides of the magazine can be varied with the main and auxiliary side hooks on each side held integrally.

Since the sheet separating device according to the present invention is constructed as featured above, the flat sheets stacked in the magazine can be reliably separated one by one regardless of the kinds and sizes of the sheets. More particularly, since the side hooks which are operable inversely to the seam hooks for supporting the sheets are provided two separately as the main side hook and the auxiliary side hook on each of the left and right sides of the magazine and their supporting positions for the sheets as well as the interval between the side hooks on the left and right sides of the magazine are made variable, and since upon operation the actuations of the main side hooks and the auxiliary side hooks via cam mechanisms are made adjustable in relative timing with respect to the actuations of the seam hooks, the suction arms and the vacuum cup arm, separation of the sheets can be achieved perfectly one by one. Moreover, since the supporting positions of the main and auxiliary side hooks for the sheets as well as the interval between the side hooks on the left and right sides of the magazine are variable, the sheet separating device can be easily adapted to different kinds and sizes of sheets.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
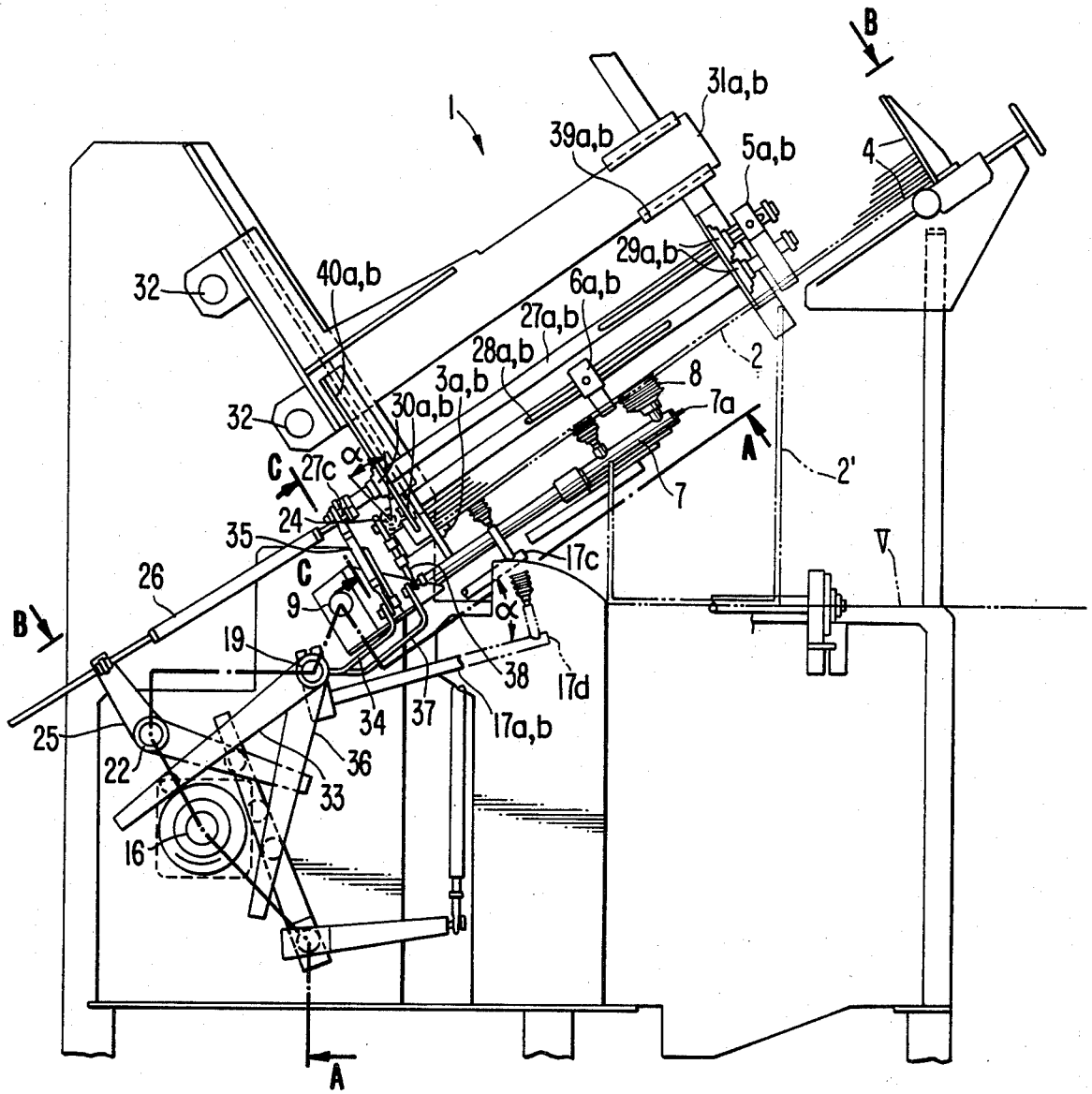
FIG. 1 is a side view of a sheet separating delivery device in a packaging machine showing one preferred embodiment of the present invention.
Figure 2:
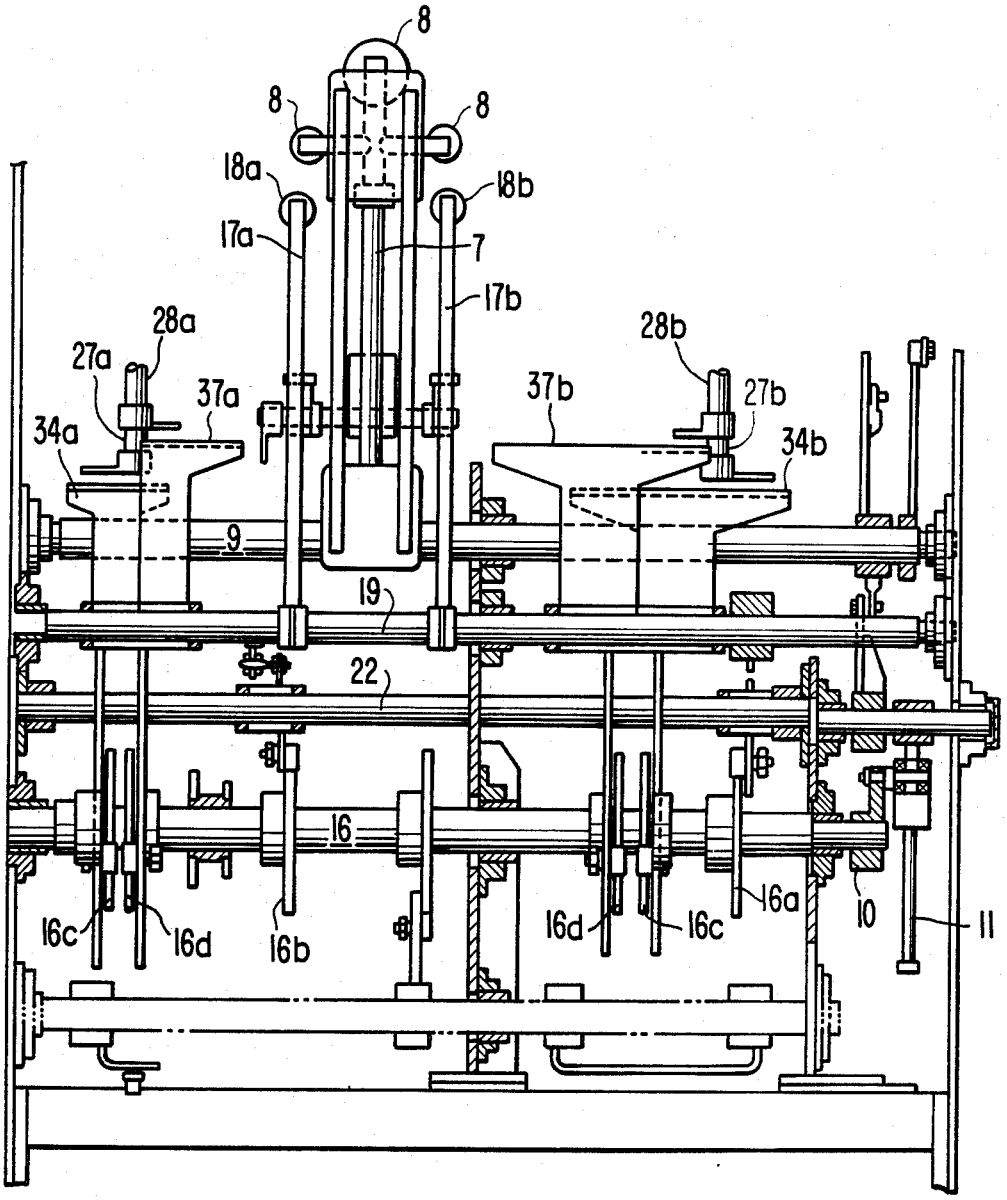
FIG. 2 is a cross-sectional view taken along line A—A in FIG. 1 as viewed in the direction of arrows.
Figure 3:
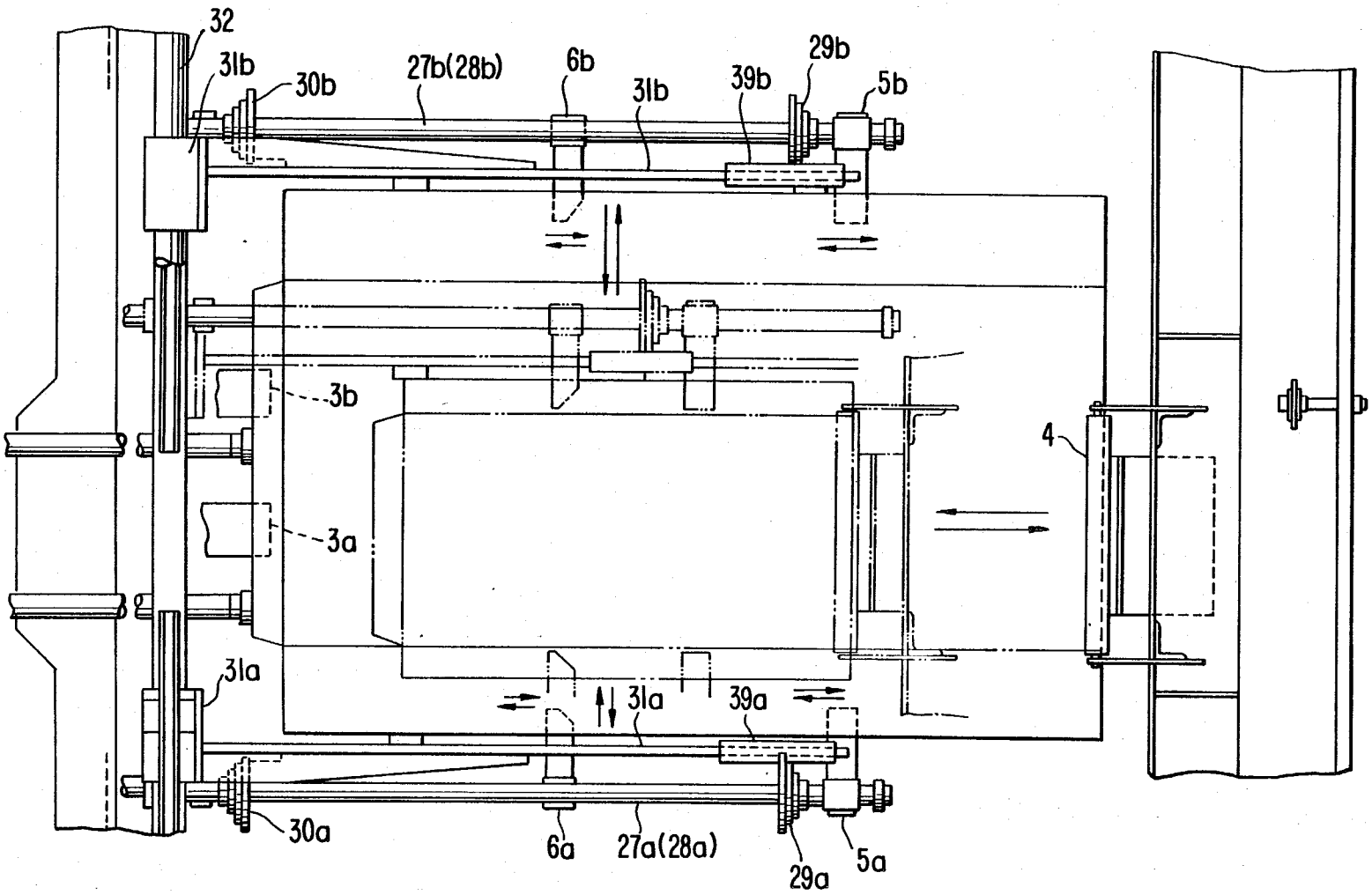
FIG. 3 is a cross-sectional view taken along line B—B in FIG. 1 as viewed in the direction of arrows.
Figure 4:
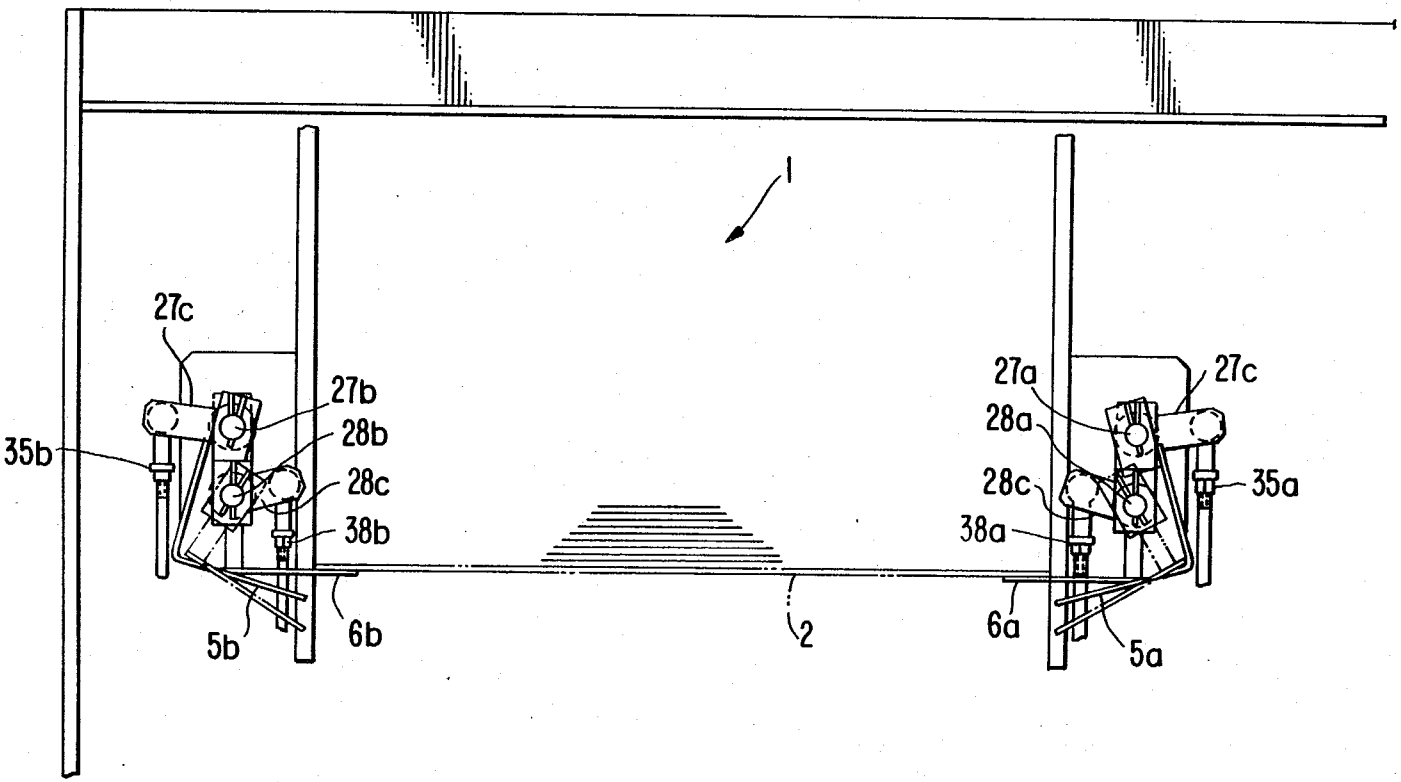
FIG. 4 is a cross-sectional view taken along line C—C in FIG. 1 as viewed in the direction of arrows.
Figure 5:
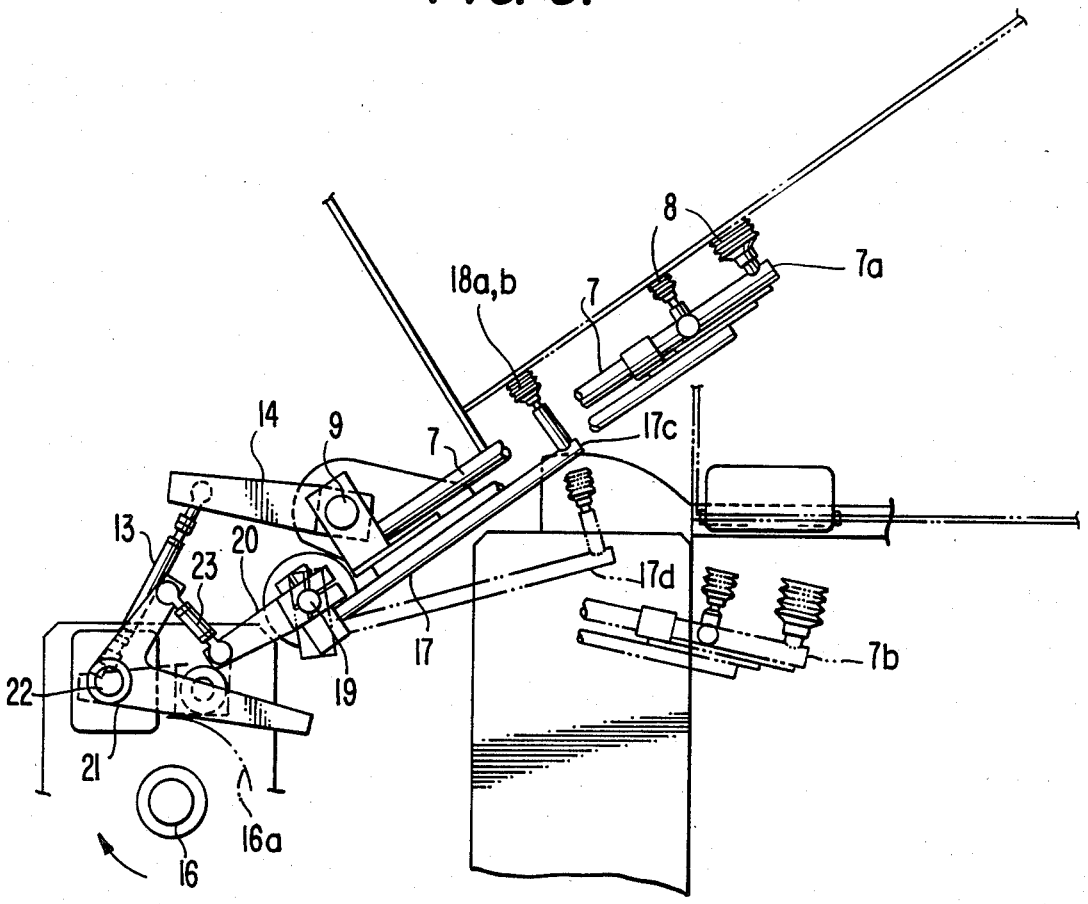
FIG. 5 is a schematic view illustrating a mode of operation of suction arms in FIG. 1.
Figure 6:
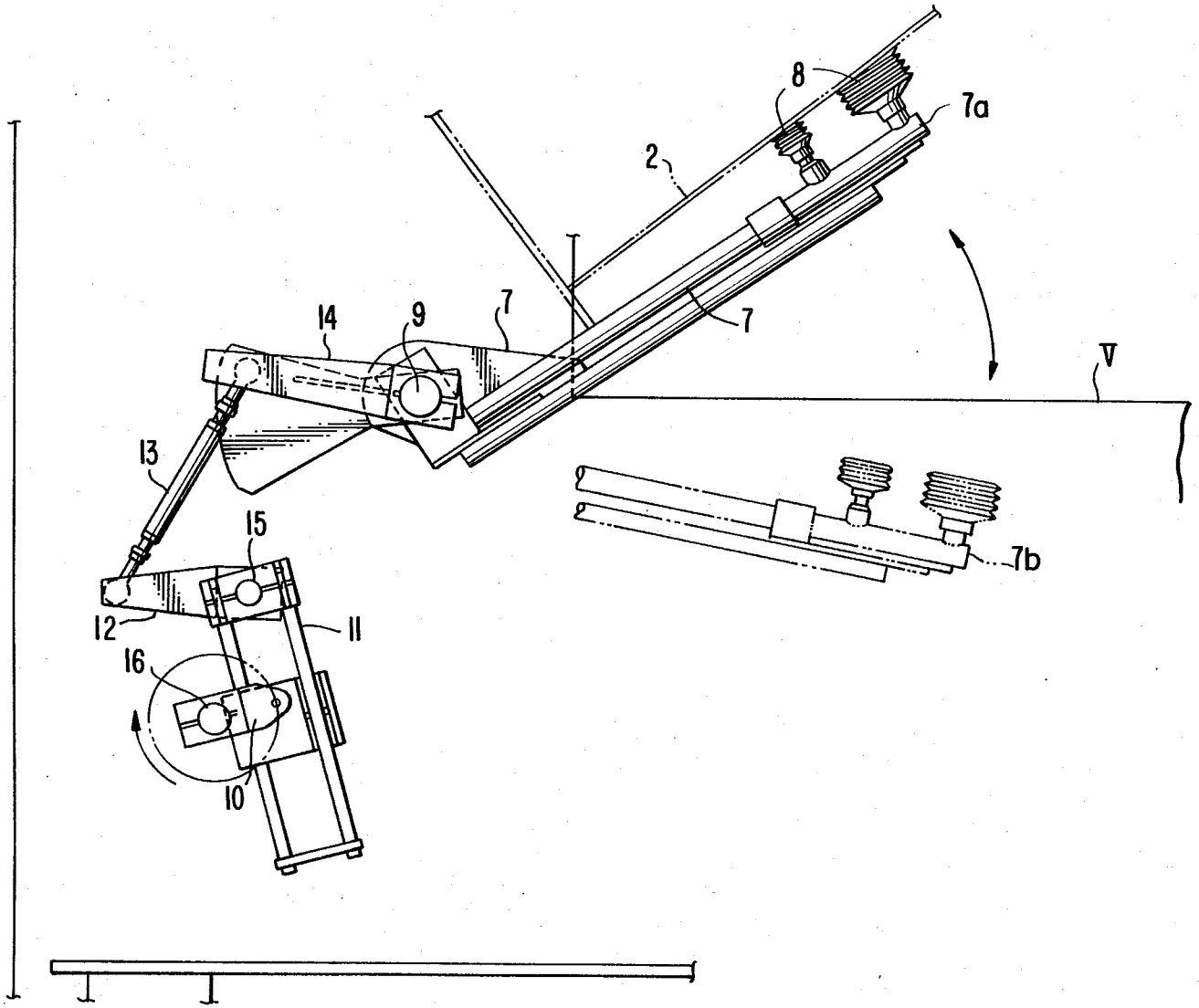
FIG. 6 is a schematic view illustrating a mode of operation of a vacuum cup arm in FIG. 1.
Figure 7:
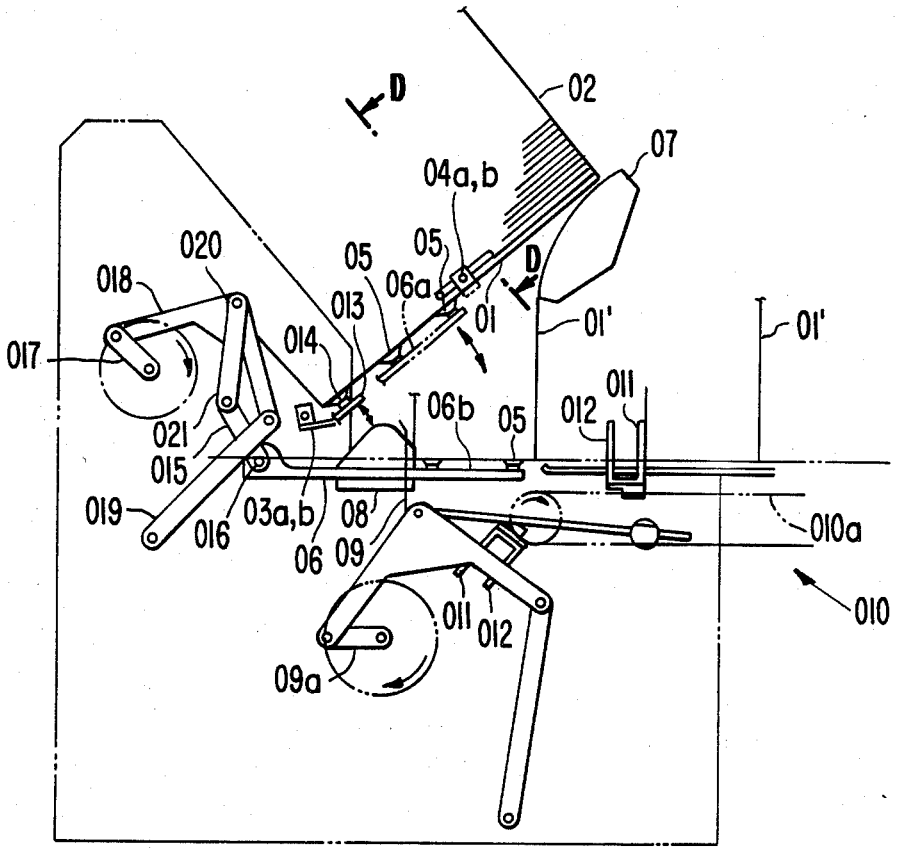
FIG. 7. (PRIOR ART)
FIG. 7 is a side view of a wraparound caser in the prior art.
Figure 8:
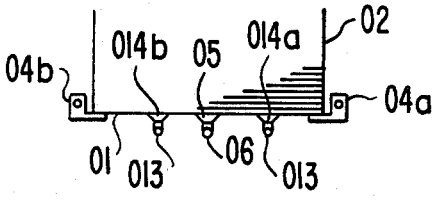
FIG. 8. (PRIOR ART)
FIG. 8 is a cross-sectional view taken along line D—D in FIG. 7.

In FIGS. 1 through 6, sheets accommodated in a magazine 1 which is disposed in an inclined attitude are supported by seam hooks 3*a* and 3*b* and hooks 4 at the bottom of the magazine 1, and by main side hooks 5*a* and 5*b* and auxiliary side hooks 6*a* and 6*b* at the both left and right side surfaces of the magazine 1. A vacuum cup arm 7 is supported by a rotatable shaft 9, a predetermined number of vacuum cups 8 are mounted to the tip end of the arm 7, and the vacuum cup arm 7 is adapted to be rocked about a fulcrum at the shaft 9. To a drive link 10 are successively articulated a link 16 and a link 12, and these links 11 and 12 are both rotatably supported by a shaft 15 which is in turn supported from a machine frame. Here, if a link 14 fixedly secured to the shaft 9 is rotatably jointed with the link 12 via a bar 13 whose length is adjustable, when in response to rotation of the drive link 10 about a fulcrum at a shaft 16, the vacuum cup arm 7 would perform intermittent motion, in which the arm 7 rocks between positions 7*a* and 7*b* and it stops for a predetermined period at the position 7*b*.

Suction arms 17*a* and 17*b*, respectively, have vacuum cups 18*a* and 18*b* mounted at their tip ends, and are supported by a shaft 19 which is in turn rotatably supported from the machine frame so as to be moved jointly with the shaft 19, an L-shaped cam lever 21 which makes slide movement along a cam 16*a* via a cam follower in response to rotation of the cam 16*a* mounted to the shaft 16, is rotatably supported at one point thereon via a shaft 22, and by rotatably connecting a lever 20 fixedly secured to the shaft 19 to the other arm of the L-shaped lever 21 via a bar 23 whose length is adjustable, the suction arms 17*a* and 17*b* would rock between the positions 17*c* and 17*d*.

The seam hooks 3*a* and 3*b* are supported by a shaft 24 which is in turn supported from the machine frame, and if one end of the hook is rotatably connected with one tip end of a V-shaped cam lever 25 that is rotatably supported by the shaft 22 which is in turn supported from the machine frame via a bar 26 whose length is adjustable, then the other arm of the V-shaped cam lever 25 is held in contact with a cam 16*b* via a cam follower, hence the cam mechanism is constructed in such manner that in response to rotation of the cam 16*b* fixedly mounted to the shaft 16, the seam hooks 3*a* and 3*b* can be rocked by an angle $\alpha$ about a fulcrum at the shaft 24 from the position for supporting the sheet 2 in the direction for releasing the sheet 2 as shown in FIG. 1.

In addition, the main side hooks 5*a* and 5*b* are mounted on shafts 27*a* and 27*b*, respectively, so as to be movable for positioning in the axial direction, the shafts 27*a* and 27*b* as well as shafts 28*a* and 28*b* are rotatably supported at their opposite end portions by bearings 29*a*, 29*b* and 30*a*, 30*b* with a predetermined interval held therebetween, stands 39*a* and 39*b* having inclined upper bearings 29*a* and 29*b* mounted thereon are slidably disposed on plates 31*a* and 31*b*, respectively, disposed on a magazine frame, while stands 40*a* and 40*b* having lower bearings 30*a* and 30*b* mounted thereon are slidably disposed at predetermined positions on the magazine frame, and further, the plates 31*a* and 31*b* are respectively slidably disposed as employing a shaft 32 as a guide. It is to be noted that at the locations where the shafts 27*a* and 27*b* project from the ends of the bearings 30*a* and 30*b*, respectively, links 27*c* fixedly secured to these shafts 27*a* and 27*b*, respectively, are rotatably connected to links 34 supported by the shaft 19 via bars 35 whose lengths are adjustable. Furthermore, due to the fact that a cam lever 33 supported by the shaft 19 is rocked by rotation of a cam 16*c* mounted to the shaft 16 via a cam follower, the shafts 27*a* and 27*b* would repeat normal and inverse rotations, and so, the main side hooks 5*a* and 5*b* mounted to these shafts 27*a* and 27*b* are adapted to repeat the rocking motions from their positions for supporting the sheet to their positions for releasing the sheet and vice versa.

The auxiliary side hooks 6*a* and 6*b* also have the same construction, in which at the locations where the shafts 28*a* and 28*b* project from the ends of the bearings 30*a* and 30*b*, respectively, links 28*c* fixedly secured to these shafts 28*a* and 28*b*, respectively, are rotatably connected to links 37 supported by the shaft 19 via bars 38 whose lengths are adjustable. Due to the fact that a cam lever 36 supported by the shaft 19 is rocked by rotation of a cam 16*d* mounted to the shaft 16 via a cam follower, the shafts 28*a* and 28*b* are operated inversely to the shafts 27*a* and 27*b*, respectively, and would repeat normal and inverse rotations, and so, the auxiliary side hooks 6*a* and 6*b* mounted to these shafts 28*a* and 28*b* are adapted to repeat the rocking motions from their positions for supporting the sheet to their positions for releasing the sheet and vice versa.

New description will be made in the sequence of operations on the mechanisms for reliably separating the sheet 2 from the lowermost position of the magazine 1 one by one and pulling out the sheet onto the upper surface V of a bucket conveyor in the next stage as folded into a V-shape 2'. In the beginning, the suction arms 17*a* and 17*b* and the vacuum cup arm 7 are respectively located at the positions indicated by 17*c* and 7*a* respectively. At first, the seam hooks 3*a* and 3*b* supporting the sheets 2 and the auxiliary side hooks 6*a* and 6*b* are simultaneously actuated to rock them in the direction for releasing the sheets 2, at the same time the lowermost sheet 2 is sucked by the vacuum cups 18*a* and 18*b* mounted on the suction arms 17*a* and 17*b*, respectively, and as soon as the suction arms 17*a* and 17*b* have been pulled down up to the position 17*d* by a predetermined angle, the seam hooks 3*a* and 3*b* and the auxiliary side hooks 6*a* and 6*b* are rocked and restored to their original positions to support the remaining sheets.

Subsequently, the main side hooks 5*a* and 5*b* are rocked in the direction for releasing the sheet 2, at the same time the bottom surface of the lowermost sheet 2 is sucked by a number of vacuum cups 8 disposed on the vacuum cup arm 7, and when the arm 7 has been pulled down by a predetermined angle up to the position 7*b*, the sheet 2 has been already shaped into a U-shape 2' and is delivered onto the surface V. In succession, the main side hooks 5*a* and 5*b* are rocked and restored to their original positions to support the remaining sheets. At this time, hooks on the opposite side to the seam hooks 3*a* and 3*b* are disposed at the upper portion of the inclined magazine so as to be movable along the inclination of the magazine for positioning thereof, and once the size of the sheets has been determined, the hooks on the opposite side are fixed in position.

As described above, according to the present invention, when the main side hooks 5*a* and 5*b* release the sheet 2 and suction of the lowermost sheet is effected by means of a number of vacuum cups 8 on the vacuum cup arm 7, since the main side hooks 5*a* and 5*b* release the sheet 2 under the condition that besides the seam hooks 3*a* and 3*b* as well as the opposite side hooks, the remaining sheets are firmly supported jointly by the left and right auxiliary side hooks nearly at the central portions of the both side edges of the sheets 2 to effect pull down of the lowermost sheet 2, in distinction from the condition where at such timing the side hooks provided at only one location on each side edge release the lowermost sheet 2 and the remaining sheets 2 are supported only by the seam hooks 3*a* and 3*b* and the opposite side hooks as is the case with the sheet separating device in the prior art, even if a vacuum force caused by abruptly peeling off overlapped sheets should act upon the remaining sheets, it is possible to separate the lowermost one sheet only in a reliable manner.

As explained in detail above, according to the present invention, in order to reliably separate a sheet positioned at the lowermost level in flat sheets stacked within a magazine that is disposed in an inclined attitude one by one, side hooks are disposed along the both side surfaces of the magazine in two stages consisting of main side hooks and auxiliary side hooks, when a single sheet at the lowermost level is to be separated, seam hooks and auxiliary side hooks are simultaneously actuated to release the lowermost sheet and the separation is effected by suction and pull-down by means of a suction arm, as soon as one end of the single sheet has been separated both the seam hooks as well as the auxiliary side hooks are rotated to be restored for supporting the remaining sheets, subsequently the main side hooks are actuated to release the single sheet, and only the separated single sheet is sucked and pulled down by actuation of a vacuum cup arm. Therefore, even if a vacuum force caused by abruptly peeling off overlapped sheets should act upon the remaining sheets, separation of the single sheet from the remaining sheets can be effected reliably. In addition, the construction of the sheet separating device is such that it can be easily adapted to different kinds and sizes of sheets. Also, since stable perfect separation of sheets one by one can be achieved, high speed operation of the device becomes possible, and the rate of operation of the machine can be greatly enhanced.

While the present invention has been described above in connection to one preferred embodiment of the invention, as a matter of course it is intended that the present invention should not be limited to only the illustrated embodiment but various changes and modifications in design could be made without departing from the spirit of the present invention.

What is claimed is:

1. A sheet separating device in a packing machine which machine includes a magazine disposed in an inclined attitude for accommodating flat sheets, a sheet separating device for separating only one sheet positioned at the lowermost level in said magazine from the other sheets, which device consists of seam hooks that can be rocked in the direction for supporting said sheets and in the direction for releasing the same, side hooks that can be operated inversely to said seam hooks for supporting said sheets, said seam and side hooks are operated by cam means in a mutually correlated manner, and suction arms each having vacuum cups and sucking and rocking the sheet at the lowermost level, a vacuum cup arm provided with vacuum adhesion means and driven by a crank mechanism so as to pull down said only one sheet separated by said sheet separating device and thereafter to be held still for a predetermined period of time, and fixed guides adapted to be engaged with said sheet that is being pulled down for folding said sheet into a U-shape; characterized in that in order to constitute means for reliably separating sheets positioned at the lowermost level in the magazine one by one, there are provided two stages of main and auxiliary side hooks which can be rocked in the direction for supporting said sheets and in the direction for releasing the same as operated inversely to said seam hooks, on the both left and right sides of said magazine so that said side hooks can be rocked in correlation with said suction arms, each of the respective side hooks has its supporting position for the sheets made movable, and the side hooks are adjustably disposed so that the interval between the side hooks on the left and right sides of said magazine can be varied with said main and auxiliary side hooks on each side held integrally.

* * * * *